United States Patent [19]

Kanno et al.

[11] Patent Number: 4,956,113

[45] Date of Patent: Sep. 11, 1990

[54] PROCESS FOR PREPARING A MAGNETIC FLUID

[75] Inventors: Takao Kanno, Tokyo; Yutaka Koda, Yokohama; Hirokazu Nagato, Fujisawa, all of Japan

[73] Assignee: NOK Corporation, Tokyo, Japan

[21] Appl. No.: 310,094

[22] Filed: Feb. 14, 1989

[30] Foreign Application Priority Data

Feb. 16, 1988 [JP] Japan ..... 63-31804
Mar. 8, 1988 [JP] Japan ..... 63-52755

[51] Int. Cl.[5] ..... H01F 1/28
[52] U.S. Cl. ..... 252/62.52
[58] Field of Search ..... 252/62.54, 62.56, 62.51 R, 252/62.52; 106/460

[56] References Cited

U.S. PATENT DOCUMENTS

Re. 32,573 1/1988 Furumura et al. ..... 252/62.52
3,549,396 12/1970 Dietz ..... 106/300
3,917,538 11/1975 Rosenweig ..... 252/62.52
4,430,239 2/1984 Wyman ..... 252/62.51
4,604,222 8/1986 Borduz et al. ..... 252/62.52
4,687,596 8/1987 Borduz et al. ..... 252/62.51

FOREIGN PATENT DOCUMENTS 58-174495 10/1983 Japan .

*Primary Examiner*—Jeffrey E. Russel
*Assistant Examiner*—Stephen G. Kalinchak
*Attorney, Agent, or Firm*—Fred Philpitt

[57] ABSTRACT

A magnetic fluid containing fine particles of ferrite stably dispersed in a low vapor pressure base oil is prepared by adding N-polyalkylenepolyamine-substituted alkenylsuccinimide (and a low vapor pressure base oil) to a suspension of fine particles of surfactant-adsorbed ferrite dispersed in a low boiling point hydrocarbon solvent, heating the resulting mixture, separating the hydrocarbon solvent therefrom, adding a low vapor pressure base oil and a specific dispersing agent to the fine particles of N-polyalkylenepolyamine-substituted alkenylsuccinimide-coated ferrite as the residues and subjecting the resulting mixture to a dispersion treatment.

29 Claims, No Drawings

PROCESS FOR PREPARING A MAGNETIC FLUID

BACKGROUND OF THE INVENTION

1. Field of the Invention

This invention relates to a process for preparing a magnetic fluid, and more particularly to a process for preparing a magnetic fluid having an improved saturation magnetization by stably dispersing fine particles of ferrite in a low vapor pressure base oil at a high concentration.

2. Description of the Prior Art

Fine particles of ferrite are prepared by pulverization, co-precipitation, vapor deposition, etc., although a co-precipitation procedure is usually used from the viewpoint of purity, particle size control, productivity, etc. However, co-precipitation is a precipitation reaction from an aqueous solution containing iron ions, and thus the resulting fine magnetic particles are in a suspended state in an aqueous solution.

On the other hand, it is desirable that the fine particles of a magnetic material for a magnetic fluid are not in a coagulated state, but in an individually dispersed state. Thus, in the case of fine particles of a magnetic material prepared by co-precipitation it is necessary to adsorb a surfactant so as to prevent a coagulation or agglomeration onto the surfaces of the fine magnetic particles in a dispersed liquid state without passing through a drying step which causes a risk of coagulation and agglomeration of the fine particles themselves. Therefore, a water-soluble surfactant is used.

A dispersing base oil for a magnetic fluid containing dispersed fine particles of water-soluble surfactant-adsorbed magnetic material is restricted to a relatively volatile solvent such as kerosine, toluene, etc., and when the magnetic fluid is used as a magnetic fluid seal, or for magnetic fluid polishing, etc., evaporation of the base oil is a problem so important as to deteriorate the function of the magnetic fluid itself.

Generally, a magnetic fluid is a dispersion of fine particles of ferrite in a base oil by using a dispersing agent such as a higher fatty acid salt, sorbitan ester, etc. However, any higher dispersibility cannot be obtained from a mere dispersion of fine particles of ferrite in a low vapor pressure base oil and such a dispersion is not used in practical applications.

Even if a higher dispersibility could be obtained from such dispersion in a low vapor pressure base oil, it would take much time to form a uniform suspension, because the low vapor presure base oil has a high kinematic viscosity such as 8–50 Cst (40°) in contrast to those of ordinary organic solvents or water such as 1 Cst or less (40°). Still furthermore, all of the fine particles of ferrite to be dispersed are not formed into a stable suspension, and a considerable proportion of the fine particles of ferrite is removed at its purification by centrifuging, etc. There is also a problem of a very low efficiency.

Prior art of using a low vapor pressure base oil as a dispersing base oil for a magnetic fluid containing fine particles of water-soluble surfactant-adsorbed magnetic material in a dispersed state is disclosed in Japanese Patent Application Kokai (Laid-open) No. 58-174,494, U.S. Pat. No. 4,430,239, etc.

Japanese Patent Application Kokai (Laid-open) No. 58-174,494 discloses a process for preparing a magnetic fluid by adding a water-soluble surfactant and a low boiling point organic solvent to fine particles of a magnetic material, thereby forming a suspension of fine particles of surfactant-adsorbed magnetic material dispersed in the low boiling point organic solvent, then adding a low vapor pressure base oil and a polyether-type, nonionic surfactant as a dispersing agent to the suspension, removing then low boiling point organic solvent therefrom by distillation, and dispersing the fine particles of the magnetic material in the low vapor pressure base oil.

U.S. Pat. No. 4,430,239 discloses a process for preparing a magnetic fluid by using a long chain alcohol ester of phosphoric acid as a dispersing agent in place of the polyether-type, nonionic surfactant in the process of said Japanese Patent Application Kokai (Laid-open) No. 58-174,494.

SUMMARY OF THE INVENTION

An object of the present invention is to provide a magnetic fluid containing fine paticles of ferrite stably dispersed in a low vapor pressure base oil and having a higher saturation magnetization than that of the prior art magnetic fluid.

Another object of the present invention is to provide a process for preparing a magnetic fluid containing fine particles of ferrite stably dispersed in a low vapor pressure base oil at a high concentration.

DETAILED DESCRIPTION OF THE PREFERRED EMBODIMENTS

These objects of the present invention can be attained by adding N-polyalkylenepolyamine-substituted alkenylsuccinimide to a suspension of fine particles of surfactant-adsorbed ferrite dispersed in a low boiling point hydrocarbon solvent, heating the resulting mixture at a temperature of not less than about 70° C., then separating the low boiling point hydrocarbon solvent therefrom, adding a low vapor pressure base oil having a vapor pressure of not more than 0.1 mm Hg at 25° C. and a dispersing agent selected from N-polyalkylenepolyamine-substituted alkenylsuccinimide, a phosphoric acid ester having a mono- or di-oxyalkylene substituent group and a nonionic surfactant to the fine particles of N-polyalkylenepolyamine-substituted alkenylsuccinimde-coated ferrite as the residues, and subjecting the resulting mixture to a dispersion treatment.

In the present process, fine particles of surfactant-adsorbed ferrit having particle sizes of about 50 to about 300 Å, preferably about 70 to about 120 Å are thoroughly dried to remove a water as an inhibiting factor at dispersion into oil therefrom and then dispersed in a low boiling point hydrocarbon solvent capable of relatively readily dispersing the fine particles, therby forming a stable, low boiling point hydrocarbon-based suspension according to the prior art procedure.

Fine particles of ferrite can be used irrespective of their preparation procedures, but it is preferable from the viewpont of purity, particle size control, and, above all, productivity to use fine particles of ferrite prepared by co-precipitation.

The surfactant to be adsorbed on the fine particles of ferrite includes those usually used for dispersing fine particles into a low boiling point hydrocarbon solvent, as given below, and preferably higher fatty acid salts and sorbitan esters are used.

Higher fatty acid salts such as sodium oleate, sodium erucate, etc.

Sorbitan esters such as polyoxyethylene sorbitan ester, etc.

Higher fatty acids such as oleic acid, stearic acid, etc.

Dialkylsulfosuccinates such as Aerosol-OT, etc.

Polyoxyethylene alkyl aryl ethers such as polyoxyethylene nonyl phenyl ether, etc.

Polyoxyethylene alkyl ethers such as polyoxyethylene lauryl ether, etc.

Polyoxyethylene alkyl ester

Alcohol sulfuric acid ester as dodecylsulfuric acid ester, etc.

Alkylbenzenesulfonic acid

Phosphates such as oleyl phosphate, etc.

Polyoxyethylene alkyl amine

Glycerine ester

Aminoalcohol ester

The low boiling point hydrocarbon solvent includes aliphatic, alicyclic and aromatic hydrocarbon solvents having a boiling point of about 60° to about 200° C., and, for example, at least one of n-hexane, n-heptane, n-octane, i-octane, n-decane, cyclohexane, toluene, xylene, mesitylene, ethylbenzene, petroleum ether, petroleum benzine, naphtha, ligroin, etc. can be used.

A mixture of fine particles of said surfactant-adsorbed ferrite and the low boiling point hydrocarbon solvent is subjected to a dispersion treatment, for example, in a homogenizer and, if necessary, to centrifuging to remove precipitates therefrom, whereby a suspension having a dispersion concentration of about 0.01 to about 30%, preferably about 0.1 to about 20% by weight, is formed. At a higher dispersion concentration than the upper dispersion concentration, the fine particles of ferrite undergo gelation and no stable suspension can be formed.

The resulting low boiling point hydrocarbon-based suspension can be subjected, if necessary, to a conventional procedure for purifying a magnetic fluid to remove particles having too large particle sizes or a poor dispersibility, for example, by centrifuge or by placing the magnetic fluid under a magnetic field gradient, whereby a magnetic fluid of higher quality can be obtained.

Then, the stable, low boiling point hydrocarbon-based suspension is admixed with a second surfactant to coat the fine particles of ferrite. The low boiling point hydrocarbon for use in formation of the suspension is desirably those capable of dissolving the second surfactant. The second surfactant includes a detergent dispersant, a kind of a lubricating oil additives, etc. and an ashless detergent dispersant is preferable when the fine particles of ferrite are subjected to a heat treatment after coating with the second surfactant.

As the second surfactant, about 0.1 to about 10% by weight of the following compound is used on the basis of the low boiling point hydrocarbon that forms the suspension:

(1) N-polyalkylenepolyamine-substituted alkenylsuccinimide, represented by the following formulae:

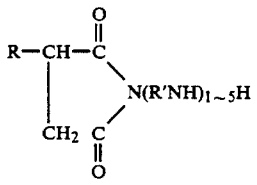

-continued

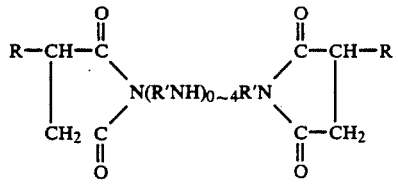

where R is a hydrocarbon group having 12 to 24 carbon atoms and a polybutenyl group having a molecular weight of about 300 to about 2,000, and R′ is an alkylene group having 1 to 6 carbon atoms and can be the same or different when at least two of R′ are repeated.

(2) Multipolar acrylic acid ester polymer having the following basic structure:

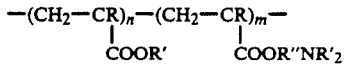

where R is a hydrogen atom or a methyl group, R′ is a lower alkylene group, and R″ is a divalent group such as an alkylene group, an arylene group, etc.

The low boiling point hydrocarbon-based suspension containing the second surfactant is subjected to a heat treatment at a temperature of about 70° C. or higher with stirring. The heat treatment is carried out at a reflux temperature of low boiling point hydrocarbon, and the low boiling point hydrocarbon can be also removed therefrom by distillation without refluxing at that time. Furthermore, the heat treatment can be also carried out in the presence of a low vapor pressure base oil, as will be described later, where the heat treatment is carried out at a temperature of about 200° to about 300° C. under atmospheric pressure, or reduced pressure, or in an inert gas atmosphere for about 30 to about 60 minutes and the low boiling point hydrocarbon solvent can be removed therefrom by distillation at the same time.

Then, the residues from the removal of the low boilng point hydrocarbon therefrom by distillation or a mixture thereof with the low vapor pressure base oil is usually washed with a solvent mixture of toluene-acetone, toluene-methanol, n-hexane-acetone, i-octane-acetone, etc., whereby the surfactant and low boiling point hydrocarbon in excess, or thermal decomposition products, etc., which cause an increase in the viscosity of the resulting magnetic fluid or a lowering of the dispersion concentration of fine particles of magnetic material, can be removed. After the washing, the fine particles of magnetic material are dried, if required.

The thus obtained fine particles of second surfactant-coated magnetic material are admixed with a low vapor pressure base oil and a third surfactant. The dispersibility into the low vapor pressure base oil is in a good state by virtue of the foregoing heat treatment.

The low vapor pressure base oil includes liquid oils having a vapor pressure of not more than 0.1 mg Hg, preferably 0.01 mm Hg at 25° C., for example, natural oils such as white oil (liquid paraffin), mineral oil, spindle oil, etc. and synthetic oils such as higher alkylbenzene, higher alkylnaphthalene, polybutene (molecular weight: about 300- about 2,000), dicarboxylic acid diesters (such as dioctyl azelate, dioctyl adipate, dioctyl sebacate, dibutyl phthalate, dihexy maleate, etc.), polyols (such as neopentylglycol, trimethylolpropane, pentaerythritol, dipentaerythritol, etc.), polyolpolyesters of these polyols with carboxylic acids having 6 to 10 carbon atoms (such as trimethylol propane tri-n-heptyl ester, penta-aerythritol tetra-n-hecyl ester, pentaerythritol tetra-2-ethylhexyl ester, etc.), phosphoric acid triesters (such as phosphoric acid tributyl ester, phosphoric acid tri-2-ethylhexyl ester, phosphoric acid tricresyl ester, etc.), and a lubricating oil containing so-called lubricating additives such as an antioxidant, an anti-attrition agent, an oiliness improver, a detergent dispersant, etc. They are used to make a dispersion concentration of fine particles of ferrite about 10 to about 50% by weight in the magnetic fluid.

On the other hand, the third surfactant selected from the following three kinds of compounds is used generally in an amount of about 1 to about 20% by weight on the basis of the low vapor pressure base oil:

(1) N-polyalkylenepolyamine-substituted alkenylsuccinimide, represented by the following formulae:

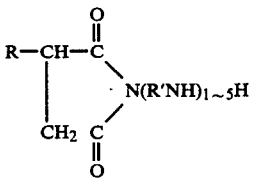

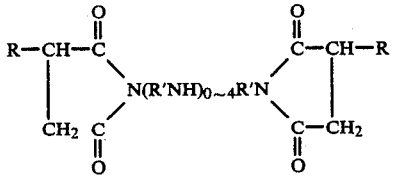

wherein R is a hydrocarbon group having 12 to 24 carbon atoms or a polybutenyl group having a molecular weight of about 300 to about 2,000 and R′ is an alkylene group having 1 to 6 carbon atoms and can be the same or different when at least two of R′ are repeated.

(2) Phosphoric acid esters having a mono- or dioxyalkylene group, represented by the following formulae, or their mixture:

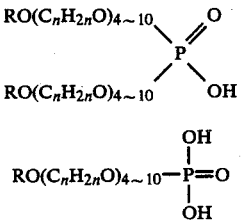

where R is an alkyl group having 6 to 18 carbon atoms or an alkylphenyl group having an alkyl group having 5 to 10 carbon atoms and n is 2 or 3.

(3) Nonionic surfactant including an ethylene oxide type such as polyoxyethylene alkylaryl ether, polyoxyethylene alkyl ether and polyoxyethylene alkyl ester; a sorbitan-fatty acid ester type such as sorbitan-higher fatty acid mono(tri)-ester; a polyoxyethylene sorbitan fatty acid ester type such as polyoxyethylene sorbitan-fatty acid mono(tri)ester; and a glycerin ester type such as glycerin-higher fatty acid mono(tri)ester.

Dispersion treatment of the resulting mixture is carried out according to an ordinary procerdure in a homogenizer, an ultrasonic mixer, a vibrating mill, etc., where addition of a small amount of a low boiling point hydrocarbon solvent is effective for increasing the dispersion efficiency.

After the dispersion treatment, the resulting dispersion is washed with a solvent mixture as in the treatment after the additon of the second surfactant, if required, When the low boiling point hydrocarbon solvent is added to the residues or when the washing is carried out with the solvent mixture, it is preferable from the view point of controlling the dispersion concentration or evaporative component of the magnetic fluid to subject the resulting magnetic fluid to a heat treatment under reduced pressure, thereby removing the low boiling point components as a distillate. The dispersibility of the mangnetic fluid is never deteriorated by the heat treatment.

Furthermore, purification of the magnetic fluid by centrifuge or by leaving the magnetic fluid standing under a magnetic field gradient, as mentioned before, can be used, if required.

According to the present process, a magnetic fluid containing fine particles of a magnetic material stably dispersed in a low vapor pressure base oil as a necessary condition for various applications including a magnetic fluid seal can be efficiently and simply prepared by making a suspension of fine particles of ferrite in such a surfactant-adsorbed state as not to make coagulation and dispersed in a low boiling point hydrocarbon solvent at first, and then coating the fine particles with a second dispersing agent and a third dispersing agent. Furthermore, the resulting magnetic fluid contains fine particles of magnetic material at a high concentration such as about 40 about 50% by weight, and thus can have a higher saturation magnetization.

When N-polyalkylenepolyamine-substituted alkenylsuccinimide is used as a dispersing agent, a magnetic fluid having a higher saturation magnetization can be obtained without using the same dispersing agent twice as the second and third dispersing agents.

That is, a magnetic fluid containing fine particles of ferrite stably dispersed in a low vapor pressure base oil can be obtained by adding the low vapor pressure base oil and N-polyalkylenepolyamine-substituted alkenylsuccinimide to a suspension of fine particles of surfactant-adsorbed ferrite dispersed in the low boiling point hydrocarbon solvent and heating the resulting mixture at a temperature of about 70° C. or higher, thereby removing the low boiling point hydrocarbon solvent therefrom as a distillate. The thus obtained magnetic fluid has a saturation magnetization by about 50% higher than that when a polyoxyalkylene-substituted phosphoric acid ester or a nonionic surfactant is used as the dispersing agent (see Example 8 and Comparative Examples 3–4 which follow).

In that case, the low boiling point hydrocarbon-based suspension containing a solution mixture of the low vapor pressure base oil and N-polyalkylenepolyamine-substituted alkenylsuccinimide dispersing agent is heated usually at a temperature of about 70° about 140° C. with stirring, if necessary, under reduced pressure to remove the low boiling point hydrocarbon solvent therefrom as a distillate. The additon of the solution mixture is usually carried out before the heating, but can be made in the course of distillation and concentration, but must be made before generation of coagulated powder as result of overconcentration.

At a lower heating temperature than about 70° C., for example, at a water bath temperature, the coagulated powder generates remarkably and the desired magnetic fluid is hardly obtained, whereas heating to a higher temperature than about 140° C. is not objectionable, so long as it is below the thermal decomposition temperature of the low vapor pressure base oil, but there is actually no specific reason for such a higher temperature in the concentration step. By distilling of the lower boiling point hydrocarbon solvent, a magnetic fluid in the form of a stable suspension is the low vapor pressure base oil can be obtained.

PREFERRED EMBODIMENTS OF THE INVENTION

The present invention will be described in detail below, referring to Examples.

EXAMPLE 1

An aqueous 6N NaOH solution was dropwise added to 1850 ml of an aqueous solution containing 184 g of $FeCl_2.4H_2O$ and 500 g of $FeCl_3.6H_2O$ with stirring until the pH reached 11. Then, the mixture was aged at 80° C. for 30 minutes, cooled and decanted to remove the salt therefrom, whereby a magnetite suspension was obtained.

The suspension was admixed with an aqueous solution containing 70 g of sodium oleate and subjected to adsorption reaction at 90° C. for 30 minutes. Then, 1N HCl was dropwise added to the mixture with stirring until the pH reached 6, and the mixture was left standing.

The mixture was decanted with deionized water until the electroconductivity of the supernatant reached $5.5\times10^{-4}/\Omega$.cm. The residues were recovered by filtration, and dried, whereby fine particles of oleic acid-coated magnetite were obtained.

40 g of the thus obtained fine particles of oleic acid-coated magnetite was added to 250 g of xylene, and stirred at 10,000 rpm for 60 minutes in a homogenizer, Excelhomogenizer, type DX (made by Nihon Seiki Seisakusho, Japan), whereby a xylene-based suspension was obtained. Then, 100 g of the suspension was admixed with 1.8 g of polybutenylsuccinimide tetraethylenepentamine (molecular weight of polybutenyl group: about 1,300) and stirred at 10,000 rpm for 30 minutes. Xylene was removed therefrom in a rotary evaporator with heating at 160° C. under the atmospheric pressure, and the residues, i.e. fine particles of magnetite, was washed with an acetone-xylene (1:1) mixture 5 times and dried.

Then, 4.1 g of tricresyl phosphate and 0.4 g of polybutenylsuccinimide tetraethylenepentamine were added to 2 g of the thus obtained fine particles of polybutenylsuccinimide tetraethylenepentamine-adsorbed magnetite, and the mixture was subjected to a dispersion treatment by ultrasonic irradiation for 12 hours, whereby a magnetic fluid, having a saturation magnetization (16K Oe) of 247 G, in which the fine particles of magnetite were stably dispersed in tricresyl phosphate, was obtained.

EXAMPLE 2

40 g of the fine particles of oleic acid-coated magnetite, obtained in the same manner as in Example 1, and 4 g of polybutenylsuccinimide tetraethylenepentamine were added to 200 g of isooctane, and the mixture was stirred at 10,000 rpm for 60 minutes in a homogenizer, whereby an isooctane-based suspension was obtained. The suspension was transferred to an eggplant-type flask with a reflux condenser and heated at 99° C. in a nitrogen gas bubble-stirred atmosphere for 30 minutes. Isooctane was removed therefrom by distillation at 50° C. under reduced pressure in a rotary evaporator, and the residues, i.e. fine particles of magnetite, were washed with an acetone-toluene (1:1) mixture 5 times and dried.

22.5 g of alkylnaphthalene (Pump Oil-S made by Lion K.K., Japan) containing 2.5 g of polyoxyethylene nonyl phenyl ether was added to 25 g of the thus obtained fine particles of polybutenylsuccininmide tetraethylenepentamine, and the mixture was stirred at 10,000 rpm for 60 minutes in a homogenizer and then subjected to dispersion treatment by ultrasonic irradiation for 12 hours, whereby a magnetic fluid having a saturation magnetization of 500 G, in which the fine paricles of magnetite were stably dispersed at such a high consentration as 50% by weight in alkylnaphthalene, was obtained.

EXAMPLE 3

40 g of fine particles of oleic acid-coated magnetite, obtained in the same manner as in Example 1, was added to 250 g of n-octane and the mixture was stirred at 10,000 rpm in a homogenizer for 60 minutes and then subjected to a centrifugal treatment at 10,000 rpm for 30 minutes to recover the supernatant, whereby an n-octane-based suspension was obtained. 16 g of alkylnaphthalene containing 4 g of polybutenylsuccinimide tetraethylenepentamine was added to 200 of the thus obtained suspension and the mixture was stirred at 10,000 rpm in a homogenizer for 60 minutes. Then, the mixture was transferred to an eggplant-type flask and heated at 280° C. in an argon gas bubble stirring atmosphere for 30 minutes, whereby recovering n-octane as a distillate. After cooling, the residues of fine particles of magnetite were washed with an acetone-toluene (1:1) mixture 5 times and dried.

16 g of the thus obtained fine particles of polybutenylsuccinimide tetraethylenepentamine-adsorbed magnetite and 1.6 g of polybutenylsuccinimide tetraethylenepentamine were added to 14.4 g of alkylnaphthalene and the mixture was stirred at 10,000 rpm in a homogenizer for 60 minutes, whereby a magnetic fluid having a saturation magnetization of 500 G, in which the fine particles of magnetite were dispersed stably in alkylnaphthalene, was obtained.

EXAMPLES 4 AND 5

10 g of fine particles of polybutenylsuccinimide tetraethylenepentamine, obtained in the same manner as in Example 3, and 1 g of polyoxyethylene phosphoric acid ester (Example 4) or polyoxyethylene sorbitan oleyl ester (Example 5) were added to 9 g of alkylnaphthalene, and the mixture was stirred at 10,000 rpm in a homogenizer for 60 minutes and then subjected to a dispersion treatment by ultrasonic irradiation for 12 hours, where a magnetic fluid having a saturation magnetization of 470 G (Example 4) or 320 G (Example 5), respectively, in which the fine particles were dispersed at such a high concentration as 50% by weight stably in alkylnaphthalene, were obtained.

EXAMPLE 6

10 g of fine particles of polybutenylsuccinimide tetraethylenepentamine-adsorbed magnetite, obtained in the same manner as in Example 3, and 1 g of polyoxyethylene nonyl phenyl ether were added to 9 g of dioctyl sebacate, and mixture was stirred at 10,000 rpm in a homogenizer for 60 minutes and then subjected to a dispersion treatment by ultrasonic irradiation for 12 hours, whereby a magnetic fluid having a saturation magnetization of 240 G, in which the fine particles were dispersed at such a high concentration as 50% by weight stably in dioctyl sebacate, was obtained.

EXAMPLE 7

250 g of fine particles of oleic acid-coated magnetite, obtained in the same manner as in Example 1, was added to 750 g of ligroin, and the mixture was stirred at 10,000 rpm in a homogenizer for 30 minutes and subjected to a centrifugal treatment at 5,000 rpm for 30 minutes to recover the supernatant, whereby a ligroin-based suspension was obtained. 700 g of the thus obtained suspension was admixed with 63 g of alkylnaphthalene containing 7 g of polybutenylsuccinimide tetraethylenepentamine, subjected to an ultrasonic irradiation for 10 minutes and heated at 200° C. under aspirator-reduced pressure in a rotary evaporator for 30 minutes to remove the ligroin as a distillate. The residues were washed with an acetone-toluene (1:1) mixture 3 times and dried under reduced pressure.

The thus obtained fine particles for polybutenylsuccineimide tetraethylenepentamine-adsorbed magnetite was admixed with an equal weight of an alkylnaphthalene solution containing 10% by weight of polybutenylsuccineimide tetraethylenepentamine, and the mixture was subjected to an ultrasonic irradiation for 72 hours and then to a centrifugal separation at 5,000 rpm for 30 minutes, whereby a magnetic fluid having a saturation magnetization of 427 G, in which the fine particles were dispersed at such a high concentration as 50% by weight stably in alkylnaphthalene, was obtained.

Comparative Example 1

20 g of fine particles of oleic acid-coated magnetite, obtained in the same manner as in Example 1, was added to 250 g of isooctane, and the mixture was stirred at 10,000 rpm in a homogenizer for 60 minutes and then subjected to a centrifugal treatment at 10,000 rpm for recover the supernatant, whereby an isooctane-based suspension was obtained.

250 g of the thus obtained suspension was admixed with 4 g of polybutenylsuccinimide tetraethylenepentamine and stirred at 10,000 rpm in a homogenizer for 60 minutes. Then, an equal volume of acetone was added thereto, and the resulting precipitated fine particles were washed with an acetone-isooctane (1:1) mixture.

1 g of polyoxyethylene nonyl phenyl ether and 9 g of alkylnaphthalene were added thereto, and then the mixture was subjected to a homogenizer treatment at 10,000 rpm for 60 minutes and an ultrasonic treatment for 72 hours. No substantial dispersion was obtained, though the supernatant turned somewhat brownish.

EXAMPLE 8

20 g of $FeCl_2.nH_2O$ and 50 g $FeCl_3.6H_2O$ were each dissolved in 100 ml of water, and then the resulting solutions were joined together and mixed. Then, an aqueous 6N NaOH solution was dropwise added to the mixture at a trickling rate of 10 ml/min. with stirring until the pH reached 11. After the end of the dropwise addition, the mixture was refluxed with heating at 100° C. for 30 minutes, then cooled and washed with water. Total amount of the washed aqueous suspension was made 500 ml, and then admixed with 6 g of sodium oleate. The mixture was heated at 90° C. for 30 minutes, washed with water and dried.

15 g of the thus obtained fine particles of sodium oleate-coated magnetite and 200 ml of xylene were subjected to a homogenizer treatment at 10,000 rpm for 60 minutes and then to a centrifugal treatment at 10,000 rpm for 30 minutes to recover the supernatant, whereby a stable suspension containing 4.4% by weight of the mangnetite was obtained.

200 ml of the thus obtained xylene-based suspension was admixed with 10 g of a 2:1 mixture solution of alkylnaphthalene (Pump Oil-S made by Lion K.K., Japan) and polybutenylsuccinimide tetraethylenepentamine (PD-98A made by Toho Kagaku K.K., Japan) as a dispersing agent, and the mixture was heated at 70°-90° C. in vacuum for 60 minutes and then at an elevated temperature of 130° C. to remove xylene as a distillate, whereby a magnetic fluid as a stable dispersion in alkylnaphthalene was obtained.

The thus obtained magnetic fluid had a dispersed magnetite concentration of 33% by weight and a saturation magnetization of 230 G without any precipitates even upon centrifuging.

Comparative Example 2

A stable, n-hexane-based suspension having a dispersed magnetite concentration of 3.5% by weight was prepared in the same manner as in Example 8 and 200 ml of the thus prepared n-hexane-based suspension was admixed with 10 g of a 4:1 mixture solution of alkylnaphthalene and polybutenylsuccinimide tetraethylenepentamine (PD-98A). n-Hexane was removed therefrom by distillation in vacuum over a water bath and then the residues, i.e. a fluid having a dispersed magnetite concentration of 3.2% by weight were centrifuged. Substantially all of fine particles of magnetite (about 6.6 g) was precipitated without forming a magnetic fluid.

Comparative Example 3

A stable suspension having a dispersed magnetite concentration of 3.8% by weight was prepared in the same manner as in Example 8, except that an equal amount of n-octane was used in place of xylene.

200 ml of the thus prepared n-octane-based suspension was admixed with 10 g of a 3:1 mixture solution of alkylnaphthalene (Pump Oil S) and polyoxyethylene phosphoric acid ester as a dispersing agent, and n-octane was removed therefrom by distillation in a rotary evaporator heated over an oil bath at 70° C.-90° C., whereby a magnetic fluid as a stable dispersion in alkylnaphthalene was obtained. The thus obtained magnetic fluid had a dispersed magnetite concentration of 24% by weight and a saturation magnetization of 160 G.

Comparative Example 4

250 ml of a stable n-octane-based suspension obtained in Comparative Example 3 was admixed with 10 g of a 4:1 mixture solution of dioctyl sebacate and a non-ionic surfactant (Nonal made by Toho Kagaku K.K., Japan) and n-octane was removed therefrom as a distillate by heating in vacuum at 70°-120° C. Then, about 1.1 g of precipitates was removed from the residues by centrifuging, whereby a magnetic fluid as a stable dispersion in dioctyl sebactate was obtained.

The thus obtained magnetic fluid had a dispersed magnetite concentration of 20% by weight and a saturation magnetization of 140 G.

What is claimed is:

1. A process for preparing a magnetic fluid which comprises:

(a) dispersing particles of surfactant-adsorbed ferrite having particle sizes of about 50 Å to about 300 Å in a hydrocarbon solvent having a boiling point of about 60° C. to about 200° C. to thereby form a suspension, (b) admixing said suspension with a N-polyalkylenepolyamine-substituted alkenylsuccinimide, (c) heating the resulting mixture at a temperature of at least 70° C. to thereby remove said hydrocarbon solvent from said mixture, and recovering particles of N-polyalkylene-polyamine-substituted alkenylsuccinimide-coated ferrite;

(d) admixing said recovered particles of ferrite with:

(1) a base oil having a vapor pressure of not more than 0.1 mm Hg at 25° C., and (2) a dispersing agent selected from the group consisting of (i) N-polyalkylenepolyamine-substituted alkenyl succinimide, (ii) a phosphoric acid ester having a mono- or di-oxyalkylene substituent group, and (iii) a nonionic surfactant and (e) subjecting the mixture resulting from step (d) to a dispersion treatment.

2. A process according to claim 1 wherein the concentration of the particles of surfactant-adsorbed ferrite dispersed in the said hydrocarbon solvent in step (a) is about 0.01 to about 30% by weight.

3. A process according to claim 1 wherein in step (b) about 0.1 to about 10% by weight, on the basis of said hydrocarbon solvent that forms the suspension, of the N-polyalkylenepolyamine-substituted alkenylsuccinimide is added to the suspension dispersed in said hydrocarbon solvent.

4. A process according to claim 1 wherein the heating in step (c) is carried out at the reflux temperature of said hydrocarbon solvent.

5. A process according to claim 4 wherein in step (c) said hydrocarbon solvent is distilled off by the heating at the reflux temperature.

6. A process according to claim 1, wherein said base oil in step (d) is a natural oil.

7. A process according to claim 1 wherein said base oil in step (d) is a synthetic oil.

8. A process according to claim 7 wherein said synthetic oil is a polybutene, a dicarboxylic acid diester, a polyol, a polyolpolyester, a phosphoric acid triester or a lubricating oil.

9. A process according to claim 1 wherein said base oil in step (d) is used in such an amount as to make a dispersion concentration of the particles of ferrite in the magnetic fluid about 10 to about 50% by weight.

10. A process according to claim 1 wherein in step (d) about 1 to about 20% by weight, on the basis of the base oil, of the dispersing agent is used.

11. A process according to claim 1 wherein the temperature in step (c) is from about 200° C. to about 300° C.

12. A process according to claim 2 wherein the temperature in step (c) is from about 200° C. to about 300° C.

13. A process according to claim 3 wherein the temperature in step (c) is from about 200° C. to about 300° C.

14. A process according to claim 4 wherein the temperature in step (c) is from about 200° C. to about 300° C.

15. A process according to claim 5 wherein the temperature in step (c) is from about 200° C. to about 300° C.

16. A process according to claim 6 wherein the temperature in step (c) is from about 200° C. to about 300° C.

17. A process according to claim 7 wherein the temperature in step (c) is from about 200° C. to about 300° C.

18. A process according to claim 8 wherein the temperature in step (c) is from about 200° C. to about 300° C.

19. A process according to claim 9 wherein said base oil is used in step (d) in an amount so as to make a dispersion concentration of the particles of ferrite in the magnetic fluid of about 10 to about 50% by weight.

20. A process according to claim 10 wherein in step (d) about 10 to about 20% by weight, on the basis of said base oil, of said dispersing agent is added to said base oil.

21. A process for preparing a magnetic fluid which comprises:

(a) dispersing particles of surfactant-adsorbed ferrite having particle size of about 50 Å to about 300 Å in a hydrocarbon solvent having a boiling point of about 60° C. to about 200° C. to thereby form a suspension, (b) admixing said suspension with a N-polyalkylenepolyamine-substituted alkenylsuccinimide and a base oil having a vapor pressure of not more than 0.1 mm Hg at 25° C., and (c) heating the resulting mixture at a temperature of at least 70° C. to thereby remove said hydrocarbon solvent from said mixture, and recovering particles of N-polyalkylene-polyamine-substituted alkenylsuccinimide-coated ferrite.

22. A process according to claim 21 wherein a dispersion concentration of said particles of surfactant-adsorbed ferrite dispersed in said hydrocarbon solvent in step (a) is about 0.1 to about 30% by weight.

23. A process according to claim 21 wherein in step (b) about 0.1 to about 10% by weight, on the basis of said hydrocarbon solvent that forms said suspension, of the N-polyalkylenepolyamine-substituted alkenylsuccinimide is added to said suspension.

24. A process according to claim 21 wherein said base oil in step (b) is a natural oil.

25. A process according to claim 21 wherein said base oil in step (b) is a synthetic oil.

26. A process according to claim 25 wherein said synthetic oil is a polybutene, a dicarboxylic acid diester, a polyol, a polyolpolyester, a phosphoric acid triester or a lubricating oil.

27. A process according to claim 21 wherein said base oil is used in such an amount as to make a dispersion concentration of the particles of ferrite in the magnetic fluid about 10 to about 50% by weight.

28. A process according to claim 21 wherein about 1 to about 20% by weight, on the basis of said base oil, of a dispersing agent is added to said base oil.

29. A process according to claim 21 wherein said heating is carried out at the reflux temperature of said hydrocarbon solvent.

* * * * *